US005086872A

United States Patent [19]

Lin

[11] Patent Number: 5,086,872

[45] Date of Patent: Feb. 11, 1992

[54] FOLDABLE LADDER

[75] Inventor: Fan-Nan Lin, Taipei, Taiwan

[73] Assignee: Alfa Metal Corp., Taipei, Taiwan

[21] Appl. No.: 705,434

[22] Filed: May 24, 1991

[51] Int. Cl.[5] ..... E06C 1/397; E06C 5/34

[52] U.S. Cl. ..... 182/18; 182/20; 182/127; 182/129; 280/47.17

[58] Field of Search ..... 182/127, 129, 230, 20, 182/18; 280/47.131, 47.17

[56] References Cited

U.S. PATENT DOCUMENTS 3,074,507 1/1963 Pelky ..... 182/127
4,009,762 3/1977 Bjerkgard ..... 182/127
4,049,283 9/1977 Brookes ..... 182/127
4,690,248 9/1987 Killen ..... 182/127

*Primary Examiner*—Reinaldo P. Machado
*Attorney, Agent, or Firm*—Browdy and Neimark

[57] ABSTRACT

The present disclosure is related to an improved foldable ladder, and more particularly to a foldable one equipped with a pair of wheels so that the ladder can be converted into a push cart of various types for transportation of goods with ease. The foldable ladder is made up of a number of sections joined together one by one by way of adjustable knuckles which can be put in a number of different positions so that the ladder can be transformed into a plurality of forms of cart when a pair of wheels are removably attached to the bottom of the ladder.

2 Claims, 5 Drawing Sheets

FOLDABLE LADDER

FIELD OF THE INVENTION

Foldable ladders have been widely used mainly because of the flexibility thereof for easy carrying and versatile conversion into forms of available tools. The foldable ladder is equipped with a plurality of adjustable knuckles which can be varied in angle from 0 to 180 degrees at a number of preset positions so that the sections of the foldable ladder can be folded into different kind of combinations as the user wishes.

The present foldable ladder is further equipped with a pair of wheels at the bottom thereof so that the ladder can be converted into various kind of push carts for transportation of goods. To secure the operation of the foldable ladder, the adjustable knuckles of the present invention are provided with a check element marked with red and blue colors to indicate if the knuckles are rightly put into a secure position.

Conventional foldable ladder is only used to permit a worker to climb to a high position for reach of goods in a warehouse or work spots. It is not easy for the worker to transport the cargo without a vehicle or cart. The present inventor has noticed the problem and worked out a method to convert the conventional foldable ladder into different kinds of push carts by attaching a pair of wheels to the bottom thereof.

SUMMARY OF THE INVENTION

The primary object of the present invention is to provide a foldable ladder equipped with a pair of removable wheels so that the ladder can be converted into various types of push cart on which goods can be placed for easy transportation.

Another object of the present invention is to provide a foldable ladder which is equipped with a plurality of adjustable knuckles each of which is provided with a check element marked with red and blue colors to warn the user if the knuckle is put in a secure position or not.

To better illustrate the structure and operation modes and features of the present invention, a number of drawings are presented in company with a detailed description of the preferred embodiment thereof, in which:

DETAILED DESCRIPTION OF THE PREFERRED EMBODIMENT

Figure 1:
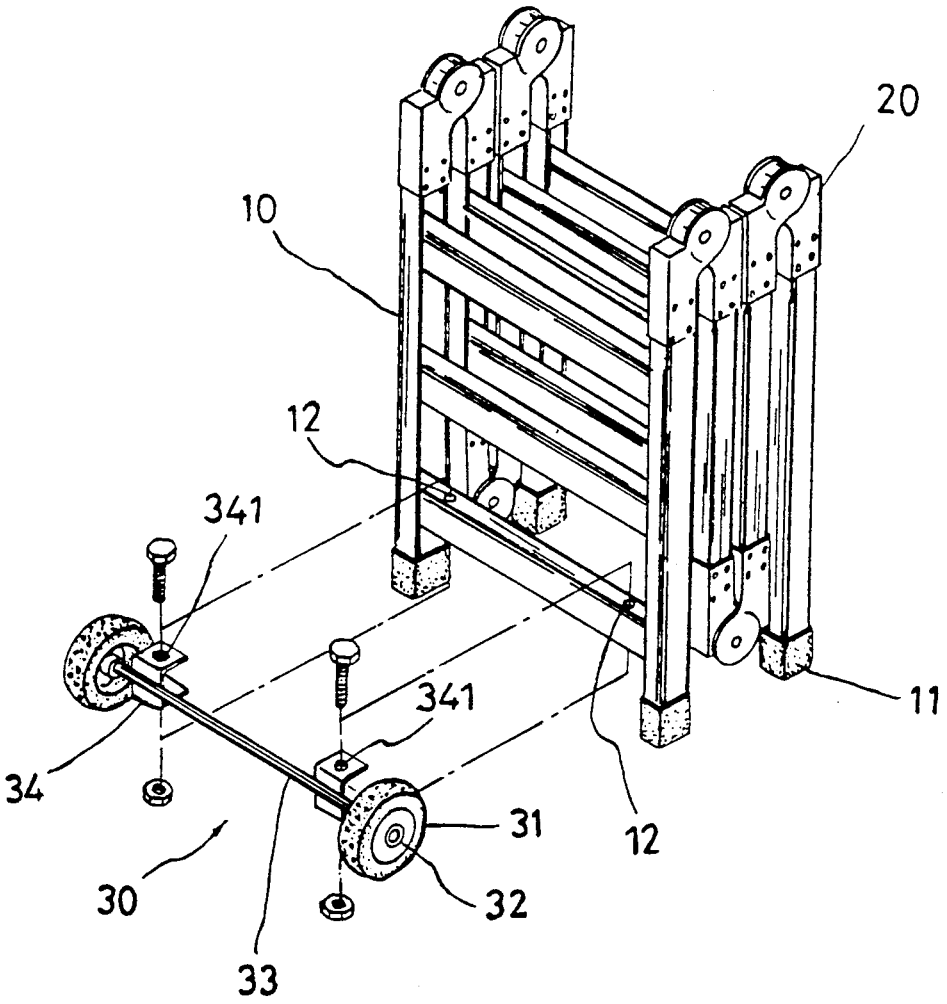
FIG. 1 is a perspective view of the folded ladder of the present invention with a pair of removable wheels attached at the bottom thereof, which are explodedly illustrated.

Referring to FIG. 1, the present convertible foldable ladder is shown with a pair of wheels 30 mounted on a shaft 33 explodedly illustrated. The conventional foldable ladder is made up of the four sections 10 joined one by one by 6 or 3 couple of adjustable knuckles 20. Each section 10 of the foldable ladder is comprised of two vertical rods and three parallel horizontal rungs.

The adjustable knuckles 20 are able to be placed in a number of present positions from 0 to 180 degrees and can be released from the set positions easily and reversely turned without stage restraint. Only rotated in one direction, the knuckle 20 will fall into an engagement position one stage at a time, when released from the engagement and rotated in opposite direction, there will be no restraint at all, permitting the operation of the knuckle 20 to be easy and fast.

Figure 2:
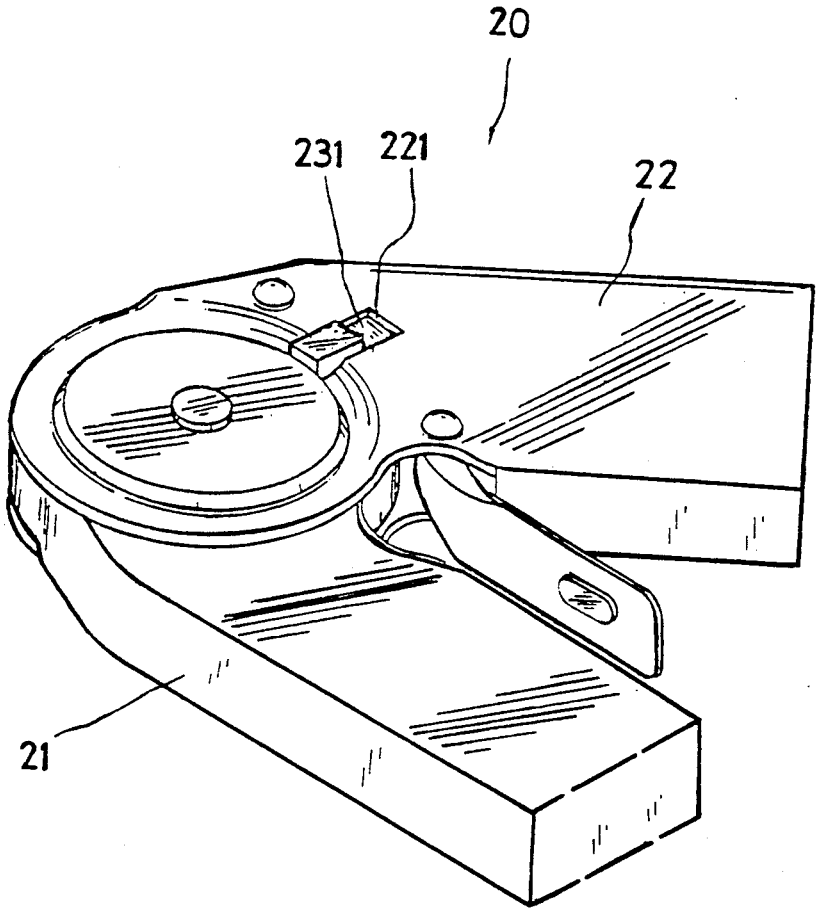
FIG. 2 is a diagram showing an adjustable knuckles applied to the present invention.
Figure 3:
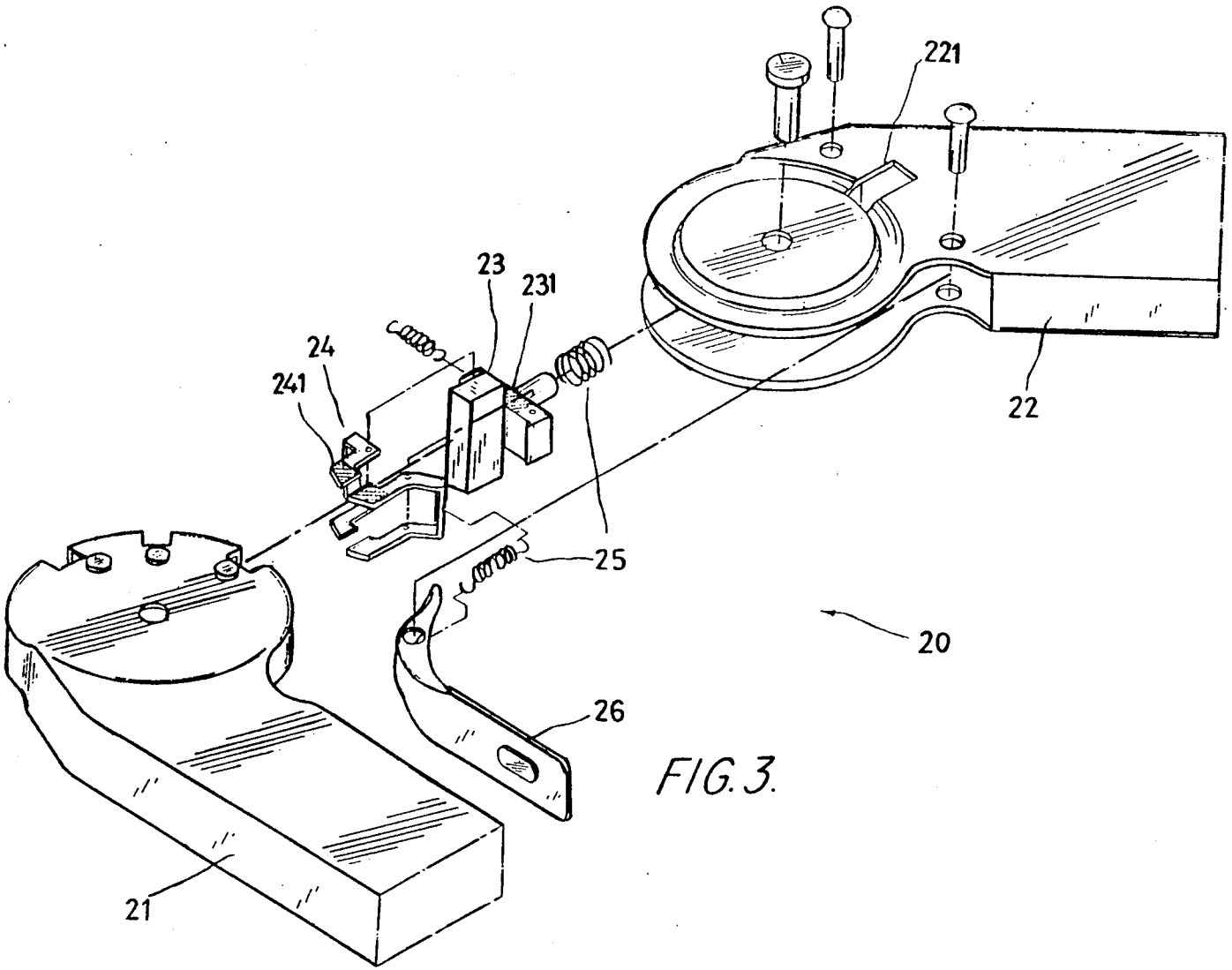
FIG. 3 is a diagram showing the exploded components of the adjustable knuckle.

The prior art adjustable knuckle 20 is used in the present invention, and is disposed between a pair of vertical rods of two sections 10 of the ladder. The knuckle 20 consists of an inner casing 21 and an outer casing 22 that form the major portion thereof. As further shown in FIGS. 2, 3, a check element made up of two portions 23, 24 wherein the portion 23 is marked with blue color 231, and the portion 24 is painted with red color 241. A spring 25 and a trigger 26 are associated with the check element to make the knuckle 20 workable. Detailed description of the operation of the same is omitted.

It is worthy of notice that the color-marked portions 23 and 24 can be exposed through the opening 221 on the outer casing 22 so that when the blue color 231 is shown, the indication means that the knuckle 20 is locked and safe to use; when the red color 241 is exposed, the indication means that the knuckle 20 is not put in a locked position, the foldable ladder is not safe for use, the user has to readjust the knuckle 20 into a locked position for use.

As shown in FIG. 1, the wheel assembly 30 is comprised of a pair of wheels 31 each having a bearing member 32 and a shaft 33. The wheels 31 are attached to the ends of the shaft 33 respectively by means of washers and split pins (not shown). Moreover, a pair of C-shaped fixture elements 34, welded to the shaft 33, are provided with through holes 341 thereon. The lowest rung of the ladder is provided with corresponding holes 12 so that the C-shaped fixture elements 34 can be engaged with the rung and tightened by bolts and nuts.

Figure 4:
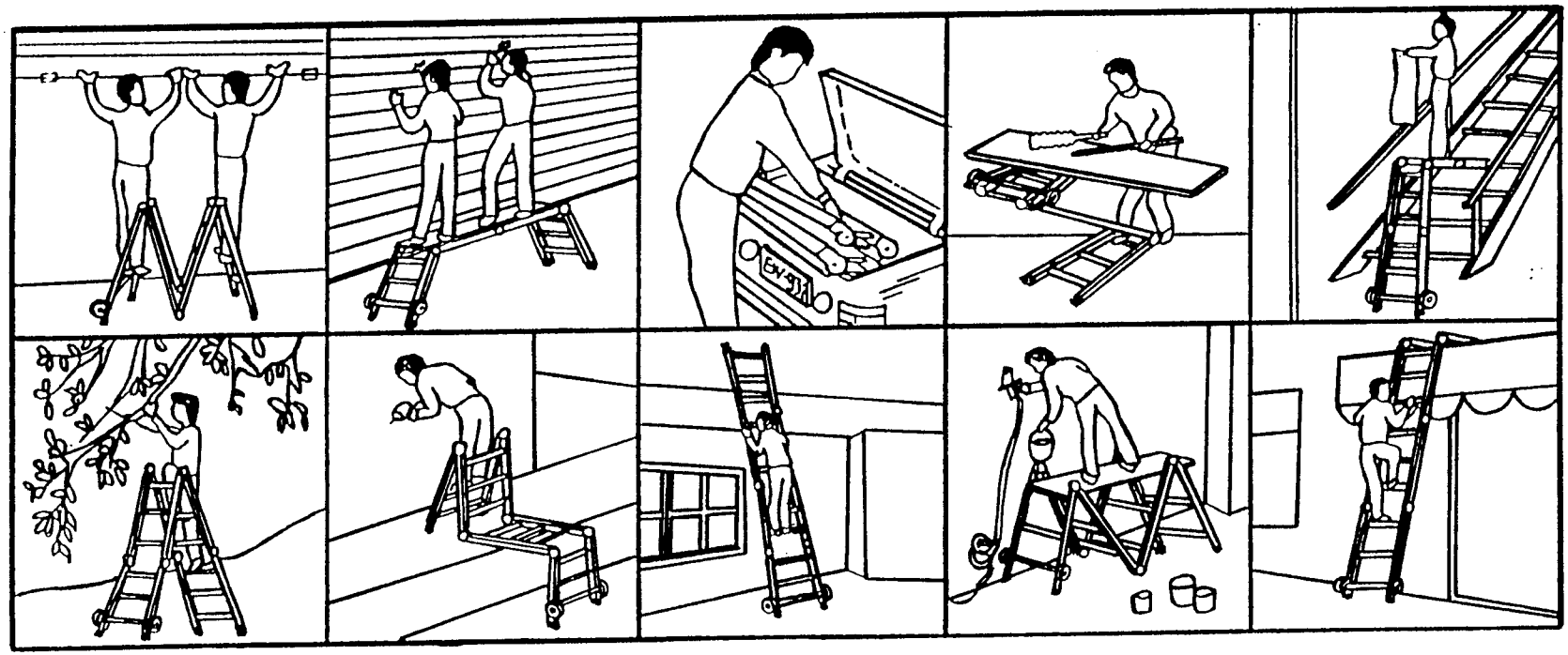
FIG. 4 is a series of illustrations showing the possible combinations the present foldable ladder when used at a work spot.
Figure 5:
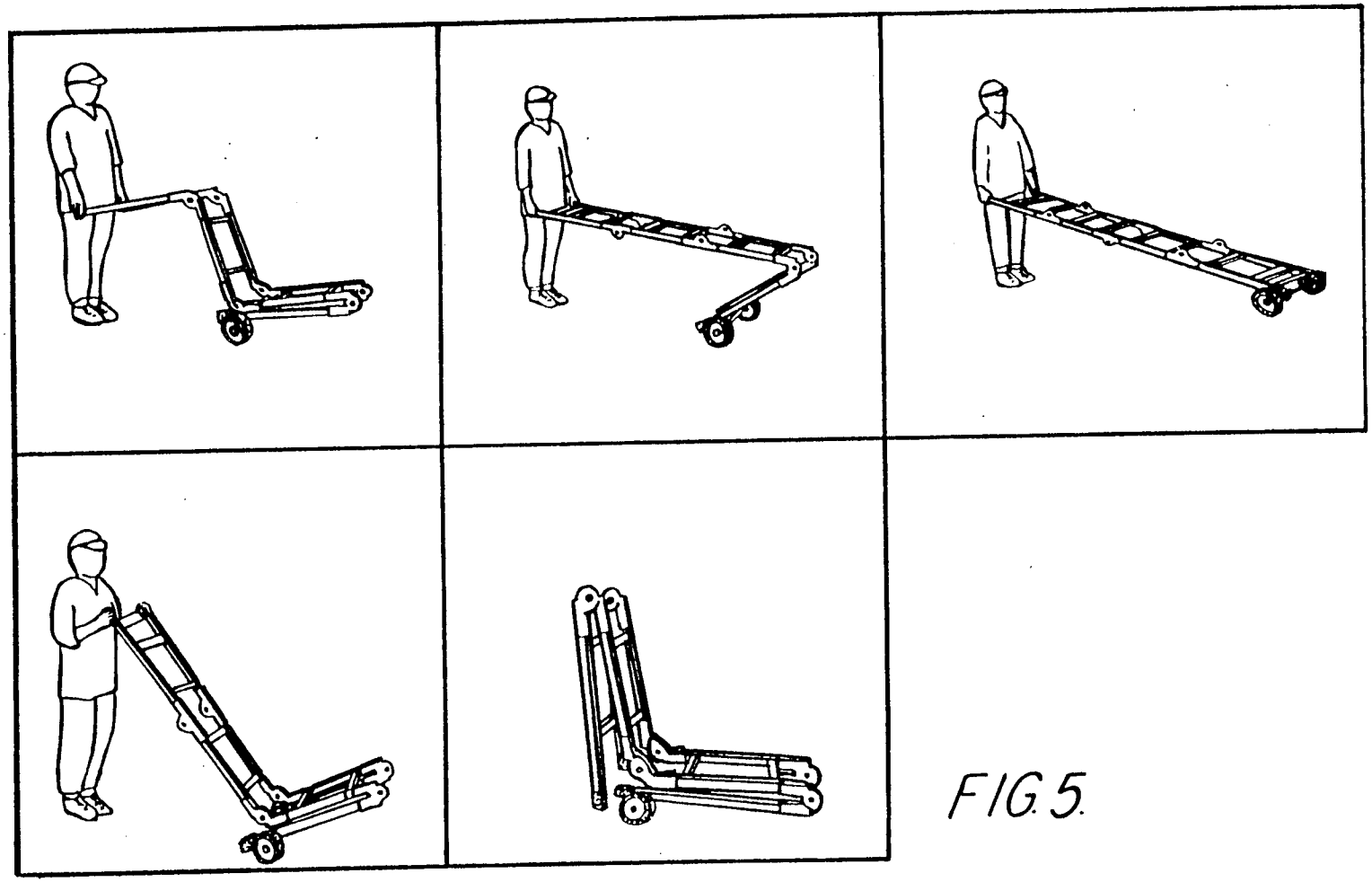
FIG. 5 is a series of illustration showing the possible types of push cart the present foldable ladder being converted into.

Referring to FIGS. 4, 5, the present foldable ladder equipped with a pair-of wheels 31 can be employed as a common foldable ladder which is able to be varied in different forms of tools fitting to various working conditions. Furthermore, it is the most important merit that the present invention can be converted into versatile types of push carts as shown in FIG. 5 in details. The conversion of a foldable ladder into a push cart of a plurality of varieties extends the use of the simple tool and facilitate a worker to transport the goods in warehouse or at working spot.

I claim:

1. A foldable ladder provided with a pair of wheels removably attached to the bottom thereof so that said ladder can be easily converted into different types of push cart, which is mainly comprised of:

a foldable ladder having a plurality of sections each made up of a pair of vertical rods and three horizontal rungs fixedly disposed between said pair of vertical rods, each section of said ladder being joined by a pair of adjustable knuckles;

a pair of wheels provided with bearings rotatably mounted to a shaft on which a pair of C-shaped fixture elements are secured so that a pair of bolts and nuts which are disposed through said C-shaped fixture elements and a pair of spaced holes disposed on the lowest rung of said ladder with said nuts screwed tightly against the bottom of said bolts so that said wheels can be removably attached to the bottom of said ladder.

2. A foldable ladder with a pair of removable wheels as claimed in claim 1 wherein each said adjustable knuckle is equipped with a check element which is marked with two different colors that are visible by a user to make sure if said knuckle is put in a secure operation mode.

* * * * *